US009809955B2

(12) United States Patent
Wright

(10) Patent No.: US 9,809,955 B2
(45) Date of Patent: Nov. 7, 2017

(54) CONTROL DEVICE FOR AN IMPLEMENT SYSTEM

(71) Applicant: Caterpillar Inc., Peoria, IL (US)

(72) Inventor: Christopher R. Wright, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 103 days.

(21) Appl. No.: 15/044,148

(22) Filed: Feb. 16, 2016

(65) Prior Publication Data

US 2017/0233983 A1 Aug. 17, 2017

(51) Int. Cl.

| | |
|---|---|
| ***E02F 9/20*** | (2006.01) |
| ***G05G 1/04*** | (2006.01) |
| ***G05G 9/047*** | (2006.01) |
| ***E02F 3/42*** | (2006.01) |
| ***E02F 3/32*** | (2006.01) |
| ***E02F 9/22*** | (2006.01) |
| ***G05G 5/00*** | (2006.01) |
| ***E02F 9/26*** | (2006.01) |

(52) U.S. Cl.

CPC ..... *E02F 9/2004* (2013.01); *E02F 3/32* (2013.01); *E02F 3/425* (2013.01); *E02F 9/2271* (2013.01); *E02F 9/265* (2013.01); *G05G 1/04* (2013.01); *G05G 5/00* (2013.01); *G05G 9/047* (2013.01); *G05G 2009/04766* (2013.01)

(58) Field of Classification Search

CPC ..... E02F 9/20; E02F 3/42; E02F 3/32; E02F 9/22; E02F 9/26; E02F 9/2004; G05G 9/047; G05G 5/00; G05G 1/04

USPC ..... 345/161

See application file for complete search history.

(56) References Cited

U.S. PATENT DOCUMENTS

| | | | | |
|---|---|---|---|---|
| 3,509,777 | A * | 5/1970 | Pfuntner | G01C 19/04 74/5.2 |
| 4,237,406 | A * | 12/1980 | Kretz | G01R 13/208 315/377 |
| 5,019,761 | A | 5/1991 | Kraft | |
| 5,675,359 | A | 10/1997 | Anderson | |
| 5,995,893 | A | 11/1999 | Lee et al. | |
| 6,429,849 | B1 * | 8/2002 | An | G05G 9/047 345/161 |
| 6,917,867 | B2 | 7/2005 | Huang et al. | |
| 8,264,458 | B2 * | 9/2012 | Cooper | G05G 9/047 345/161 |
| 8,723,638 | B2 | 5/2014 | Guglielmo | |

(Continued)

FOREIGN PATENT DOCUMENTS

| | | |
|---|---|---|
| WO | 2007144629 | 12/2007 |
| WO | 2011021150 | 2/2011 |

*Primary Examiner* — John G Weiss

(57) ABSTRACT

A control device for an implement system of a machine is provided. The control device is mounted on a support. The control device includes a first gimbal rotatably coupled to the support. The control device also includes a second gimbal rotatably coupled to the first gimbal. The control device further includes a linear actuator having a first end and a second end. The linear actuator is fixed to the second gimbal from the first end. The control device further includes a handle attached to the linear actuator at the second end. The handle is configured to move in conjunction with rotational movements of the first gimbal and the second gimbal, and a linear movement of the linear actuator to control a movement of the implement system.

20 Claims, 6 Drawing Sheets

(56) References Cited

U.S. PATENT DOCUMENTS

| | | | | |
|---|---|---|---|---|
| 9,658,639 | B2 * | 5/2017 | Taylor | B64C 13/04 |
| 2003/0152452 | A1 | 8/2003 | Hodgson | |
| 2014/0064897 | A1 | 3/2014 | Montgomery | |
| 2015/0368875 | A1 * | 12/2015 | Cook | G05G 9/02<br>74/471 R |

* cited by examiner

CONTROL DEVICE FOR AN IMPLEMENT SYSTEM

TECHNICAL FIELD

The present disclosure relates generally to a control device for an implement system of a machine, and in particular, to a control device for the implement system of an excavator.

BACKGROUND

An implement system of a typical excavator machine includes a linkage structure operated by hydraulic actuators to move a work implement. The implement system includes a boom that is pivotal relative to a machine chassis, a stick that is pivotal relative to the boom, and a work implement that is pivotal relative to the stick. Further, the machine chassis is rotatably mounted on an undercarriage or drive system of the excavator and adapted to swing about a vertical axis. The coordinated movements of the boom, the stick, the work implement and the chassis provide the overall movement of the implement system for achieving various digging operations or the like.

Most excavators utilize a right-hand control lever and a left-hand control lever to control movement of the machine chassis, the boom, the stick and the work implement. The control levers are provided in an operator cab and disposed on left and right sides of the operator's seat, respectively. The right-hand control lever controls the movement of the boom and the work implement. The left-hand control lever controls the movement of the stick and the machine chassis. Collectively or individually, the left and right control levers control the movement of the implement system while performing a digging or loading operation. However, this control system requires an operator to learn how to move the work implement by manipulating a rate of change and angular position of the boom, the stick, and the work implement.

U.S. Pat. No. 5,675,359 (referred to as '359 patent) discloses a joystick controller for utilizing omnidirectional pivoting manual displacement by an operator, to operate transducers for producing control signals. The joystick controller includes a mounting plate defining an opening and gimbal mounting means secured to the mounting plate for pivotally mounting a joystick shaft extending through the opening. The joystick shaft has an operator knob on one end, and a gauge plate on the other end. The gauge plate has a first straight edge and a second straight edge perpendicular thereto. First and second lever arms are pivotally mounted and biased against the first and second straight edges of the gauge plate. The '359 patent provides that displacement of the joystick knob causes displacement of the gauge plate and pivots the lever arms biased against the joystick knob.

SUMMARY

In one aspect of the present disclosure, a control device for an implement system of a machine is described. The control device is mounted on a support. The control device includes a first gimbal rotatably coupled to the support. The control device also includes a second gimbal rotatably coupled to the first gimbal. The control device further includes a linear actuator having a first end and a second end. The linear actuator is fixed to the second gimbal from the first end. The control device further includes a handle attached to the linear actuator at the second end. The handle is configured to move in conjunction with rotational movements of the first gimbal and the second gimbal, and a linear movement of the linear actuator to control a movement of the implement system.

In another aspect of the present disclosure, a machine is described. The machine includes an implement system, and a hydraulic control system configured to operate the implement system. The machine also includes a control device for the implement system. The control device is mounted on a support. The control device includes a first gimbal rotatably coupled to the support. The control device also includes a second gimbal rotatably coupled to the first gimbal. The control device further includes a linear actuator having a first end and a second end. The linear actuator is fixed to the second gimbal from the first end. The control device further includes a handle attached to the linear actuator at the second end. The handle is configured to move in conjunction with rotational movements of the first gimbal and the second gimbal, and a linear movement of the linear actuator to control a movement of the implement system. The control device further includes a rotatable sleeve disposed on the handle. The rotatable sleeve is also configured to control the movement of the implement system. The control device further includes a first rotational actuator connected to the first gimbal and configured to constrain the rotational movement of the first gimbal about the support, and a second rotational actuator connected to the second gimbal and configured to constrain the rotational movement of the second gimbal about the first gimbal. The machine further includes a controller configured to control the hydraulic control system and thereby operate the implement system in response to at least one of a movement of the handle and a turning of the rotatable sleeve.

In yet another aspect of the present disclosure, an excavator is described. The excavator includes a drive system, a chassis rotatably supported on the drive system, an operator station supported on the chassis and an implement system. The implement system includes a boom pivotally connected to the chassis, a stick pivotally connected to the boom, and a bucket pivotally connected to the stick. The excavator also includes a hydraulic control system configured to operate the implement system. The hydraulic control system includes a first hydraulic actuator associated with the boom and configured to rotate the boom with respect to the chassis, a second hydraulic actuator associated with the stick and configured to rotate the stick with respect to the boom, a third hydraulic actuator associated with the bucket and configured to rotate the bucket with respect to the stick, and a fourth hydraulic actuator associated with the chassis and configured to rotate the chassis with respect to the drive system. The excavator further includes a control device for the implement system. The control device is mounted on a support provided in the operator station. The control device includes a first gimbal rotatably coupled to the support. The control device also includes a second gimbal rotatably coupled to the first gimbal. The control device further includes a linear actuator having a first end and a second end. The linear actuator is fixed to the second gimbal from the first end. The control device further includes a handle attached to the linear actuator at the second end. The handle is configured to move in conjunction with rotational movements of the first gimbal and the second gimbal, and a linear movement of the linear actuator to control a movement of the implement system. The control device further includes a rotatable sleeve disposed on the handle. The rotatable sleeve is also configured to control the movement of the implement system. The control device further includes a first rotational actuator connected to the first gimbal and configured to constrain the rotational movement of the first gimbal about the support, and a second rotational actuator connected to the second gimbal and configured to constrain the rotational movement of the second gimbal about the first gimbal. The excavator further includes a controller configured to control the hydraulic control system and thereby operate the implement system in response to at least one of a movement of the handle and a turning of the rotatable sleeve.

DETAILED DESCRIPTION

Figure 1:
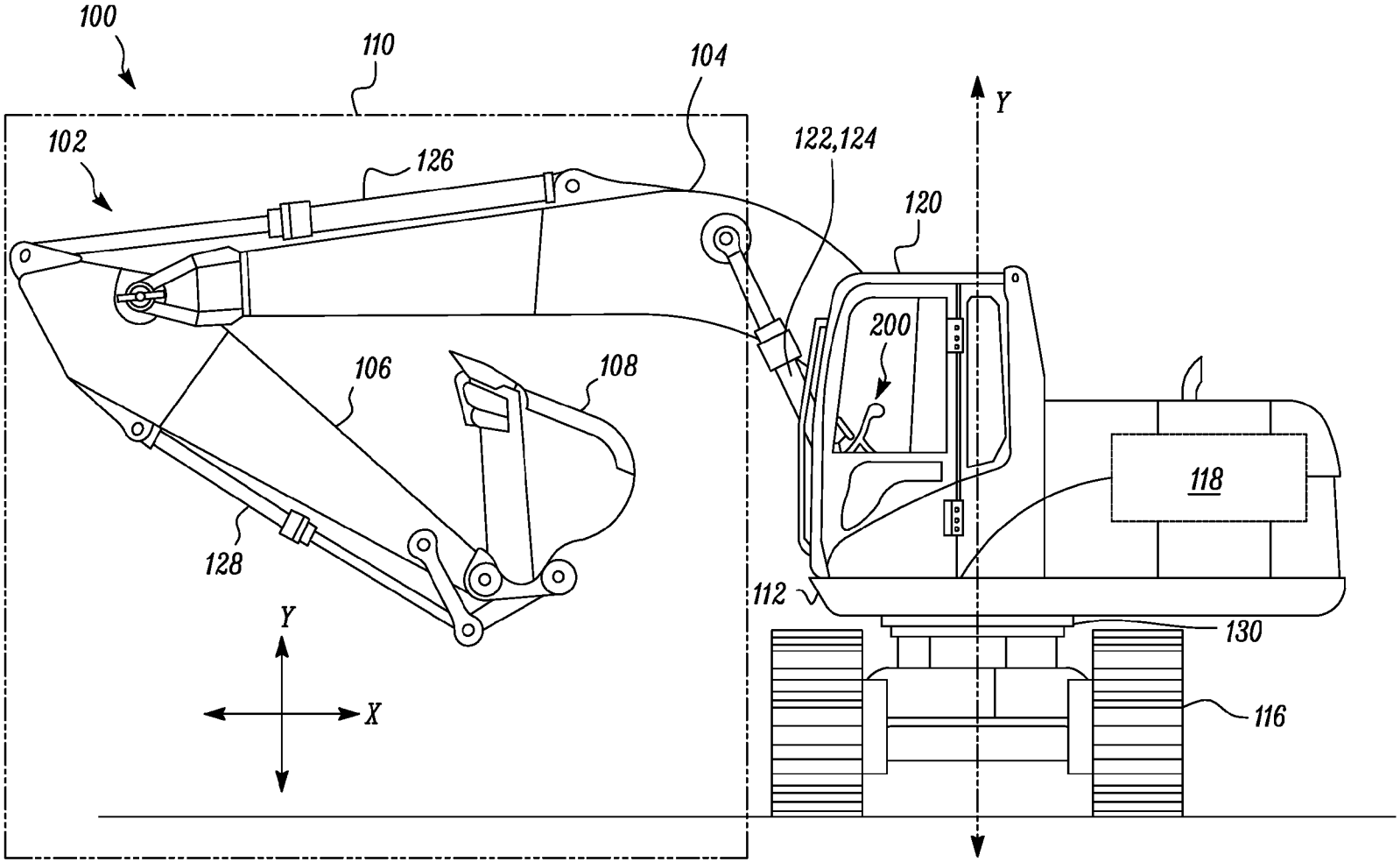
FIG. 1 illustrates a diagrammatic view of a machine having an implement system, in accordance with an embodiment of the present disclosure.

FIG. 1 illustrates a diagrammatic view of a machine 100, in accordance with an embodiment of the present disclosure. In the illustrated embodiment, the machine 100 is shown as an excavator, which may be earthmoving type or logging type. Hereinafter, any feature explained in reference to the machine 100 is also applicable to the excavator, for achieving the purposes of the present disclosure. The machine 100 includes an implement system 102, and a control device 200 for the implement system 102. The implement system 102 includes linkages such as a boom 104, a stick 106, and a bucket 108. The boom 104 is pivotally connected to a chassis 112 of the machine 100, the stick 106 is pivotally connected to the boom 104, and the bucket 108 is pivotally connected to the stick 106. In various other embodiments, the implement system 102 may be an implement system of any other excavator-type machines, such as backhoe loaders, front shovels, wheel loaders, track loaders, and skidders. Further, the work implement may be any other implement other than the bucket 108, such as, grapple, forks, hammer, rippers, shears, etc.

The machine 100 may include a drive system 116, such as, tracks, for propelling the machine 100. A power source, schematically represented and referenced by numeral 118, is provided to power the implement system 102 and the drive system 116. The power source 118 may embody an engine, for example, a diesel engine, a gasoline engine, a gaseous fuel-powered engine or any other type of combustion engine known in the art. It is contemplated that the power source 118 may alternatively embody a non-combustion source of power, such as a fuel cell, a power storage device, or another source known in the art. The power source 118 may produce a mechanical or electrical power output that may then be converted to hydraulic power for moving the implement system 102. The machine 100 may also include an operator cab 120 which provides the various controls for the machine 100. The operator cab 120 may house the control device 200 and other user interface devices for controlling the implement system 102 and the drive system 116.

In an embodiment, the implement system 102 may be, generally, set in motion, to move the bucket 108, in a first vertical plane 110 defined by a X-axis and a Y-axis. The first vertical plane 110 is a plane lying parallel to the sagittal plane, i.e., plane dividing the right zone and the left zone of an operator of the machine 100. Further, while in use, the bucket 108 may be curled and uncurled relative to the stick 106 to dig, scoop up or empty the material during the operation. The implement system 102 may be rotatable by rotating the chassis 112 at a pivot base of the boom 104 about a vertical axis, for example along the Y-axis, as schematically illustrated in FIG. 1.

An overall movement of the bucket 108 in the first vertical plane 110 may be achieved in three parts, first by raising and lowering the boom 104 with respect to the chassis 112, second by moving the stick 106 toward and outward with respect to the operator cab 120, and third by rotating the bucket 108 relative to the stick 106. The boom 104 may be raised and lowered by a pair of first hydraulic actuators 122, 124. The stick 106 may be moved towards and outward with respect to the operator cab 120 by a second hydraulic actuator 126. A third hydraulic actuator 128 may be used to curl and uncurl the bucket 108 relative to the stick 106. Moreover, the chassis 112, along with the implement system 102, may be rotated about the Y-axis by a fourth hydraulic actuator 130, such as a hydraulic motor, with respect to the drive system 116.

Figure 2:
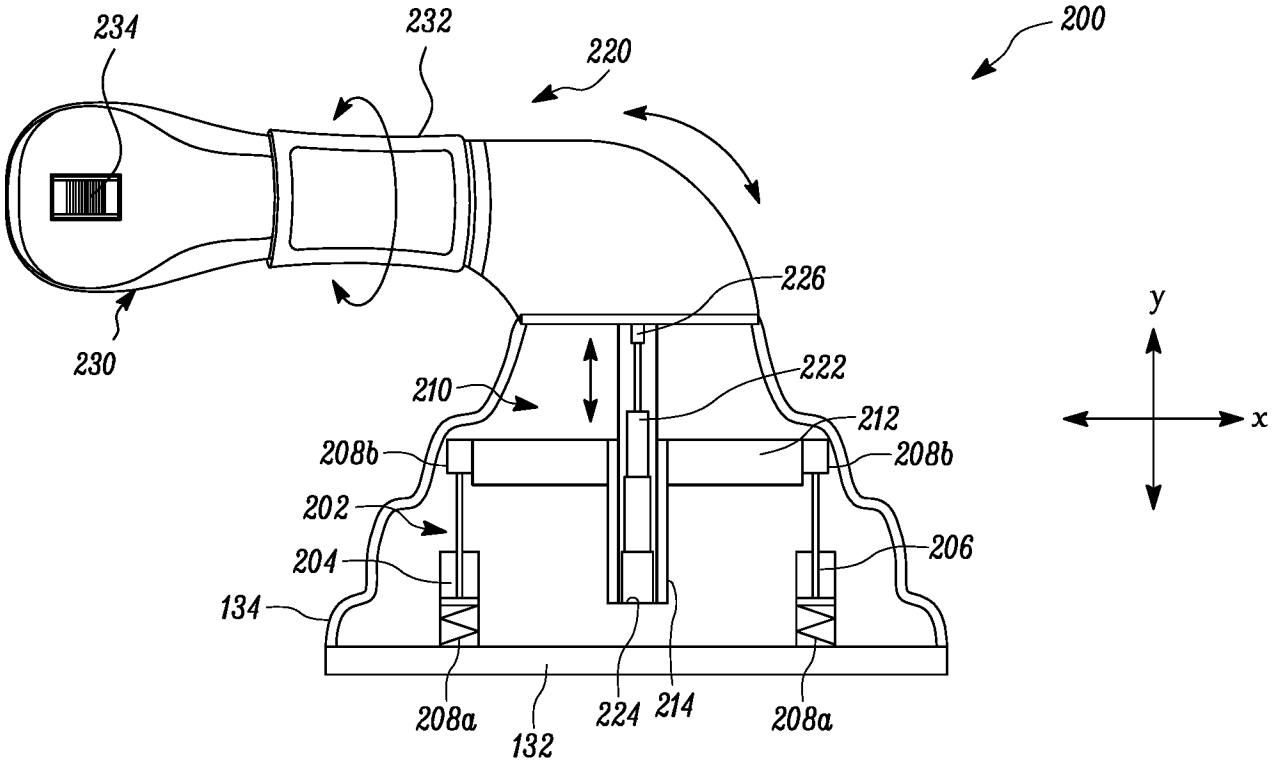
FIG. 2 illustrates a partial sectional view of a control device of the machine, in accordance with an embodiment of the present disclosure.

FIG. 2 illustrates a partial sectional planar view of the control device 200 supported on a base 132, of the operator cab 120, in accordance with an embodiment of the present disclosure. In the illustration, the control device 200 is embodied as a joystick. The control device 200 may be provided either towards a left-hand side or a right-hand side of the operator seat. The control device 200 is horizontally mounted on the base 132 such that an operator in the operator cab 120 can easily reach and grasp the control device 200 with his/her hand. In an embodiment of the present disclosure, the control device 200 may be disposed in a plane parallel to the frontal plane of the operator. While the control device 200 is described as substantially horizontal, in other embodiments, the control device 200 may be tilted with respect to the horizontal plane, as will be described later. Typically, a bellow 134 is provided to a cover for at least a partial portion of the control device 200. In the illustrated sectional view of FIG. 2, the bellow 134 is partially shown, to illustrate the internal components of the control device 200.

Figure 3:
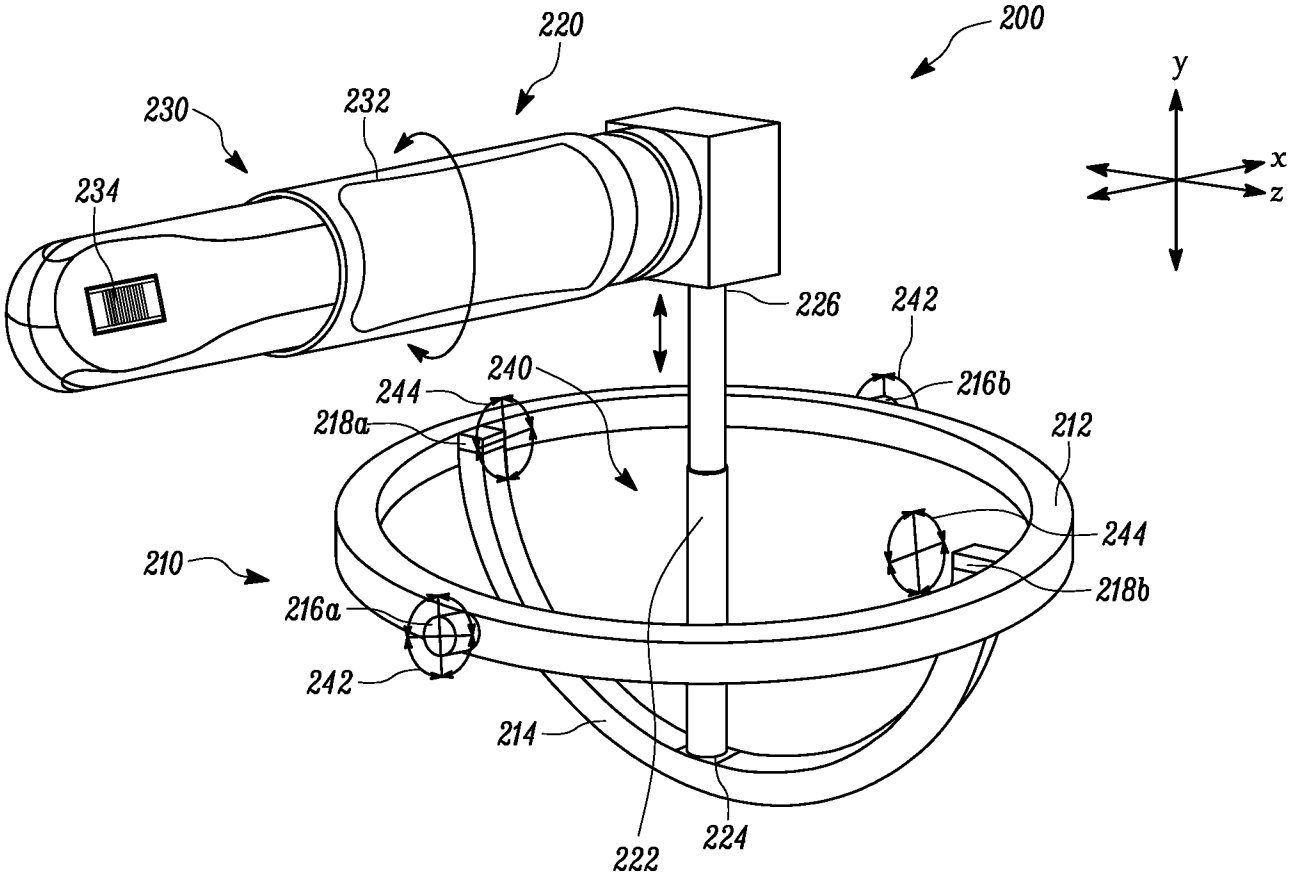
FIG. 3 illustrates a perspective elevation view of the control device, in accordance with an embodiment of the present disclosure.

FIG. 3 illustrates a perspective view of the control device 200, in accordance with an embodiment of the present disclosure. As illustrated, the control device 200 of the present disclosure, generally, includes a gimbal arrangement 210 and a handle arrangement 220 connected to each other, and working in conjunction to achieve the purpose of controlling the implement system 102. With reference to FIGS. 2-3, the control device 200 may be mounted to the base 132, via a support 202. In one example, the support 202 may include two vertical members, schematically represented and referenced by numerals 204 and 206, standing on the base 132. In one example, the gimbal arrangement 210 may be rotatably supported between the two vertical members 204, 206. In one example, the vertical members 204, 206 are connected to the base 132, from bottom ends 208*a*, and further to two diagonally opposite ends of the gimbal arrangement 210, from upper ends 208*b*. In one example, the vertical members 204, 206 may be provided in the form of two collapsible cylinders, such that the two collapsible cylinders are arranged in a manner so that these can be tilted with respect to the base 132, and therefore may allow the tilting of the gimbal arrangement 210 and thereby of the control device 200, with respect to the base 132 of the operator cab 120. In one example, the vertical members 204, 206 may be connected to the base 132 by revolute joints or the like, for achieving tilting with respect thereto.

In an embodiment of the present disclosure, the gimbal arrangement 210 includes a first gimbal 212 and a second gimbal 214. The first gimbal 212 may be rotatably coupled to the support 202. In particular, the first gimbal 212 may be coupled to the support 202 by two rotational joints 216*a*, 216*b*. Specifically, the two rotational joints 216*a*, 216*b* may connect the first gimbal 212 to the upper ends 208*b* of the two vertical members 204, 206. Similarly, the second gimbal 214 may be rotatably coupled to the first gimbal 212. In particular, the second gimbal 214 may be coupled to the first gimbal 212 by two rotational joints 218*a*, 218*b*. Specifically, the two rotational joints 218*a*, 218*b* connect the second gimbal 214 to diagonal opposite ends of the first gimbal 212. It may be contemplated by a person skilled in the art that the rotational joints 216*a*, 216*b*, 218*a*, 218*b* may include a bearing, such as a ball bearing, to facilitate rotational movement of the first gimbal 212 about the support 202 and that of the second gimbal 214 about the first gimbal 212.

In an embodiment of the present disclosure, the handle arrangement 220, of the control device 200, includes a linear actuator 222. As illustrated in FIG. 3, the linear actuator 222 has a first end 224 and a second end 226. In one example, the linear actuator 222 may be fixed to the second gimbal 214 from the first end 224. Further, the handle arrangement 220 includes a handle 230 attached to the linear actuator 222 at the second end 226. According to an embodiment of the present disclosure, the handle 230 is configured to move in conjunction with rotational movements of the first gimbal 212 and the second gimbal 214, and the linear movement of the linear actuator 222, to control the overall movement of the implement system 102. It may be contemplated by a person skilled in the art that the first and second gimbals 212, 214 and the linear actuator 222 may form a kinematic chain, in the control device 200. This kinematic chain may constrain the movement of the handle 230 by virtue of its connection with the linear actuator 222, and thus constrain the movement of the control device 200 with respect to the base 132.

As may be understood, the linear actuator 222 may expand and contract by varying a distance between the first end 224 and the second end 226. A linear movement of the linear actuator 222 is controlled by varying the distance between the first end 224 and the second end 226. In one example, the linear actuator 222 may be a telescopic piston cylinder device including hydraulic or pneumatic cylinder and piston rod configured to retract or expand under the action of any external force. In other examples, the linear actuator 222 may be another type of linear actuator device, such as a linear slider, a rack and pinion mechanism, or any other kind of straight-line mechanism.

In accordance with an embodiment of the present embodiment, the operator may reach for the control device 200 and, due to the linear actuator 222 which may contract or expand, move the handle 230 along y-axis (as shown by arrow heads in FIG. 3) to activate a scaled up movement of the implement system 102 along the Y-axis in the first vertical plane 110, as shown in FIG. 1. Also, the operator may reach for the control device 200 and, due to a rotational movement of the first gimbal 212 about the two rotational joints 216*a*, 216*b*, causes a movement of the handle 230 along x-axis (as shown by arrow heads in FIG. 3) to activate a scaled up movement of the implement system 102 along the X-axis in the first vertical plane 110, as shown in FIG. 1. Further, the operator may reach for the control device 200 and, due to a rotational movement of the second gimbal 214 about the two rotational joints 218*a*, 218*b*, causes a movement of the handle 230 along z-axis (as shown by arrow heads in FIG. 3), which in turn causes the rotation of the chassis 112 of the machine 100 to activate a scaled up movement of the implement system 102 along an axis (not shown) perpendicular to the first vertical plane 110, as shown in FIG. 1.

In an embodiment, the handle 230 may include a rotatable sleeve 232, which is rotatable with respect to a central axis thereof. In one example the central axis, disposed along x-axis, of the handle 230 may be substantially horizontal with respect to the base 132. In another example the central axis of the handle 230 may be disposed at an angle with respect to the base 132. The rotatable sleeve 232 may be configured to control the movement of the implement system 102. Specifically, the rotatable movement of the sleeve 232 may activate a scaled up curl and uncurl movement of the bucket 108 relative to the stick 106. Further, in an embodiment, the handle 230 may include an input device 234 disposed at a distal end of the handle 230. The input device 234 may be embodied as a thumb-slider or a thumbwheel, and may be turned to further adjust the scaled up curl and uncurl movement of the bucket 108 relative to the stick 106, while rotating the sleeve 232 on the handle 230. In other words, the input device 234 may be configured to change a sensitivity of the rotatable sleeve 232, for controlling the movement of the implement system 102. The control device 200 may include other types of input devices such as push buttons and switches without limiting scope of the present disclosure, these input devices may include electrical, magnetic, piezoelectric, optical, or electromechanical switches configured to output an electrical signal (either current or voltage signals).

In an embodiment, the control device 200 may include a feedback arrangement 240 for constraining the motion of the control device 200 based on the movement of the implement system 102. The feedback arrangement 240 may include a first rotational actuator 242 connected to the first gimbal 212 and configured to constrain the rotational movement of the first gimbal 212 about the support 202. For this purpose, in one example, the first rotational actuator 242 may be connected to the first gimbal 212 at one of the two rotational joints 216*a*, 216*b*. In some examples, the first rotational actuator 242 may include two first rotational actuators 242 connected at each of the two rotational joints 216*a*, 216*b*. In various examples, the first rotational actuator 242 may be capable to rotate in both directions about the corresponding rotational joints 216*a*, 216*b*. Further, the feedback arrangement 240 may include a second rotational actuator 244 connected to the first gimbal 212 and configured to constrain the rotational movement of the first gimbal 212 about the support 202. For this purpose, in one example, the second rotational actuator 244 may be connected to the first gimbal 212 at one of the two rotational joints 218*a*, 218*b*. In some examples, the second rotational actuator 244 may include two second rotational actuators 244 connected at each of the two rotational joints 218*a*, 218*b*. In various examples, the second rotational actuator 244 may be capable to rotate in both directions about the corresponding rotational joints 218*a*, 218*b*. It may be understood that the first and the second rotational actuators 242, 244 may be any actuators, such as, but not limited to, motors, that produce a rotary motion or torque. Further, in an embodiment of the present disclosure, the linear actuator 222 may form part of the feedback arrangement 240, and be configured to provide a force feedback at the handle 230. This is achieved by constraining the linear movement of the linear actuator 222 based on the movement of the implement system 102.

According to an embodiment of the present disclosure, the control device 200 may be used to control the movement of the linkages of the implement system 102 independently as well as in a simultaneously coordinated manner. The movement of the handle 230 with respect to the base 132 in the X-Y plane, via the linear movement of the linear actuator 222 and the rotational movement of the first gimbal 212, corresponds to the scaled up movement of the bucket 108 in the first vertical plane 110. Further, in order to keep the bucket 108 in a configuration for digging or loading operation, the sleeve 232 on the handle 230 and, optionally, also the input device 234 may be turned, in order to curl or uncurl the bucket 108. Furthermore, the movement of the handle 230 about the z-axis, via the rotational movement of the second gimbal 214, causes swinging of the implement system 102 about Y-axis in FIG. 1, in the direction perpendicular to the vertical plane 110.

Figure 4:
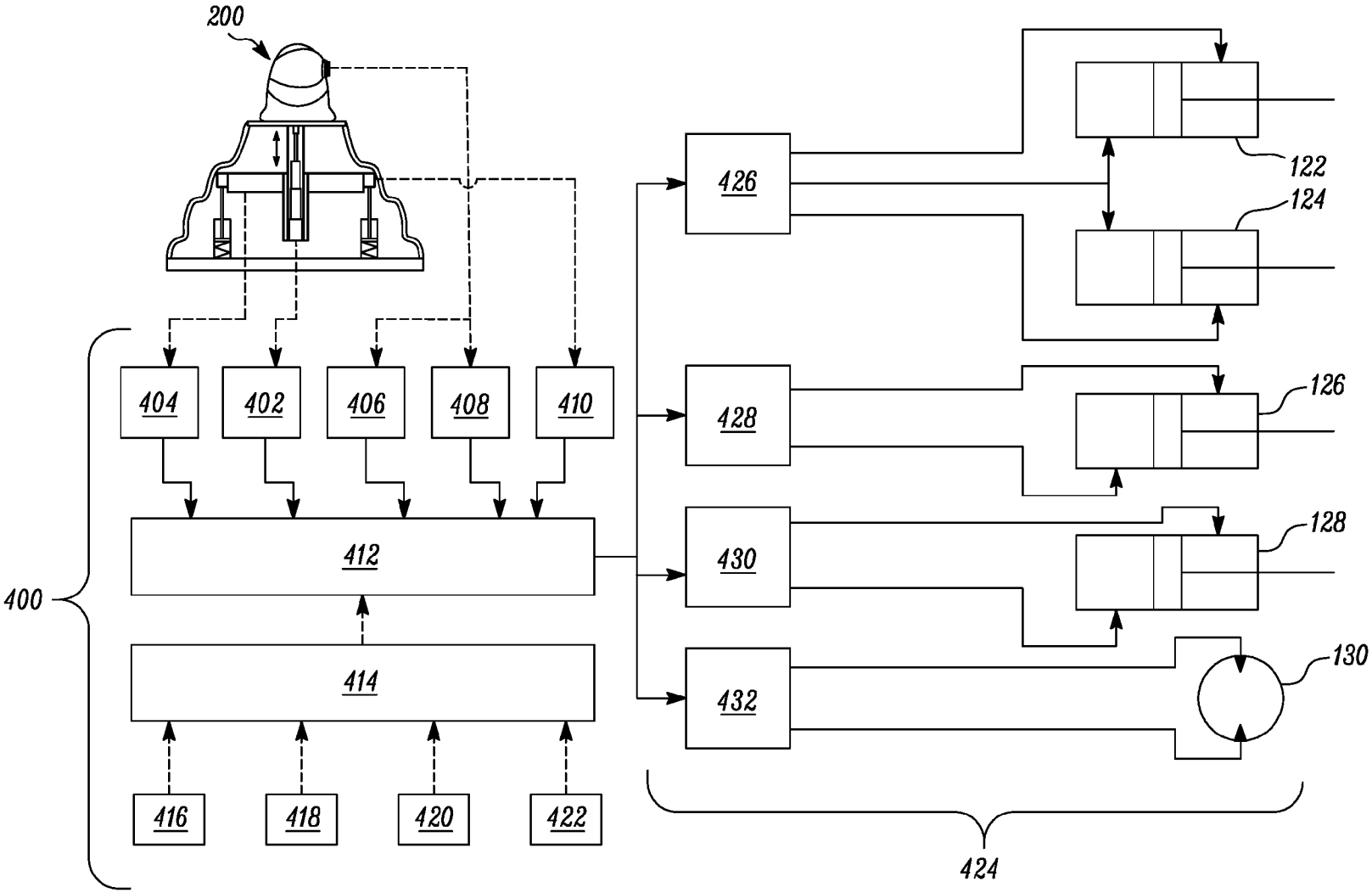
FIG. 4 illustrates a block diagram of a control system for the machine, in accordance with an embodiment of the present disclosure.

FIG. 4 is block diagram of a control system 400 for the machine 100. The control system 400 is operatively connected with the control device 200 and a hydraulic control system 424 of the machine 100. The control system 400 may include a plurality of pilot valves 402 to 410, a hydraulic manifold 412, a controller 414, and a plurality of sensors 416 to 422. According to an embodiment, the hydraulic control system 424 may include a plurality of hydraulic control valves, such as a first hydraulic control valve 426, a second hydraulic control valve 428, a third hydraulic control valve 430, and a fourth hydraulic control valve 432 for controlling the first hydraulic actuators 122, 124, the second hydraulic actuator 126, the third hydraulic actuator 128, and the fourth hydraulic actuator 130 of the machine 100, respectively. The hydraulic control valves 426-432 may be direction control valves and which may be actuated by the pilot valves 402, 404, 406-408, 410, respectively, as would be contemplated by a person skilled in the art. The pilot valves 402, 404, 406-408, 410 may, in turn, be controlled by the linear movement of the linear actuator 222, the rotational movement of the first gimbal 212, turning of the sleeve 232 and the input device 234, and the rotational movement of the second gimbal 214, respectively. In one example, the pilot valves 402-410 may be one of electromechanical, electric, magnetic control valves. The pilot valves 402-410 are configured to supply a pressurized hydraulic fluid via the hydraulic manifold 412 to the hydraulic control valves 426-432 based on the movement of the handle 230. Consequently, the hydraulic actuators 122-130 may be driven to extend or retract depending upon the directional movement of the hydraulic control valves 426-432. Further, the amount of hydraulic pressure applied to the hydraulic actuators 122-130, and therefore the speed of movement of the hydraulic actuators 122-130, may be related to the degree to which the hydraulic control valves 426-432 are actuated.

The controller 414 is configured to control the operation of the hydraulic control system 424 to achieve the scaled up movement of the implement system 102 in response to at least one of the movement of the handle 230 with respect to the base 132, and the turning of the sleeve 232 and the input device 234. More specifically, the controller 414 is configured to control a supply of hydraulic fluid to the first, second, third and fourth hydraulic actuators 122-130 in response to at least one of the movement of the handle 230 with respect to the base 132, and the turning of the sleeve 232 and the input device 234. According to an embodiment of the present disclosure, the controller 414 is operatively connected with the plurality of sensors 416 to 422. These sensors 416 to 422 are configured to generate electrical signals indicative of the position and speed of the bucket 108, the boom 104, the stick 106, and the chassis 112. The sensors 416 to 422 may be GPS based sensors, magnetic sensors, angle encoders, inclinometers, or accelerometers associated with the linkages of the implement system 102 and/or the corresponding hydraulic actuators 122-130. The controller 414 may control the operation of the hydraulic manifold 412, to maintain and supply a target hydraulic fluid pressure to the hydraulic actuators 122-130 to achieve the scaled up movement of the implement system 102 in response to the movement of the handle 230. In one example, the controller 414 may execute instructions for determining the fluid pressure for opening and closing of the hydraulic control valves 426 to 432 based on scaled up movement of the implement system 102.

According to an embodiment of the present disclosure, the controller 414 may further include lookup tables based on transfer functions and/or position maps to calculate the position of the bucket 108 in the first vertical plane 110 corresponding to a position of the handle 230 in the x-y plane. These lookup tables or position maps may be accessed to determine a scaled up target position of the bucket 108, which may be compared with the output of the sensors 416 to 422 indicative of an actual position of the bucket 108. Furthermore, the controller 414 is configured to process and calculate a differential between the target position and the actual position of the bucket 108 and accordingly provide feedback to the operator via the feedback arrangement 240 of the control device 200. It may be contemplated by a person skilled in the art that the differential may increase as the movement of the handle 230 exceeds the corresponding target position of the bucket 108. The feedback may include tactile force feedback in order to slowdown or even retard the movement of the handle 230, if the differential exceeds a predefined threshold. In particular, the linear actuator 222, and the first and the second rotational actuators 242, 244 may apply the force feedback to resist the movement of the handle 230. Otherwise, the control device 200 may allow free movement of the handle 230 in the X-Y plane, when the differential between the target position and the actual position of the bucket 108 is negligibly small, or below the threshold limit.

Figure 6:
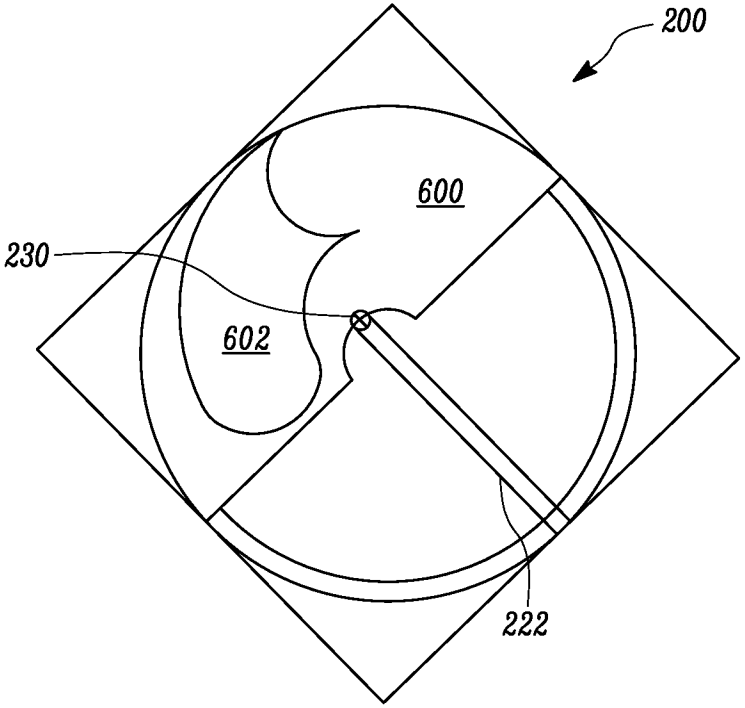
FIG. 6 illustrates a diagrammatic side view of the control device showing range of motion, in accordance with a second embodiment of the present disclosure.
Figure 5:
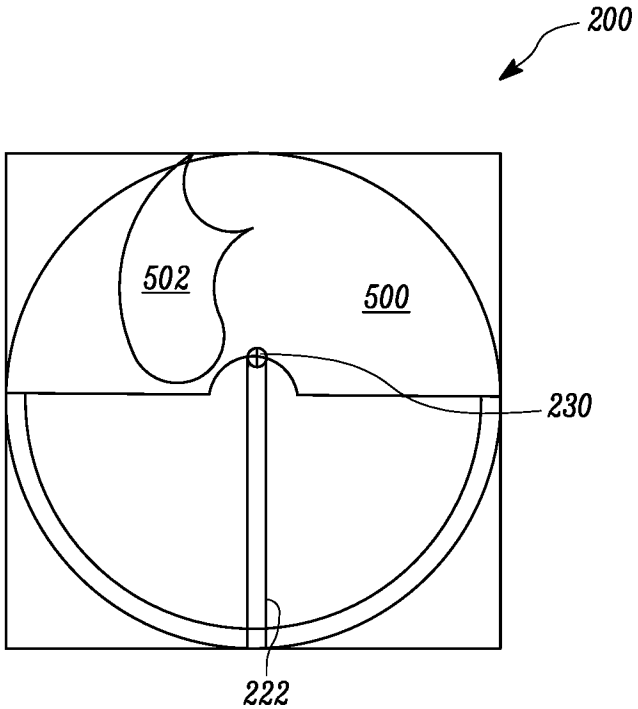
FIG. 5 illustrates a diagrammatic side view of the control device showing range of motion, in accordance with a first embodiment of the present disclosure.
Figure 7:
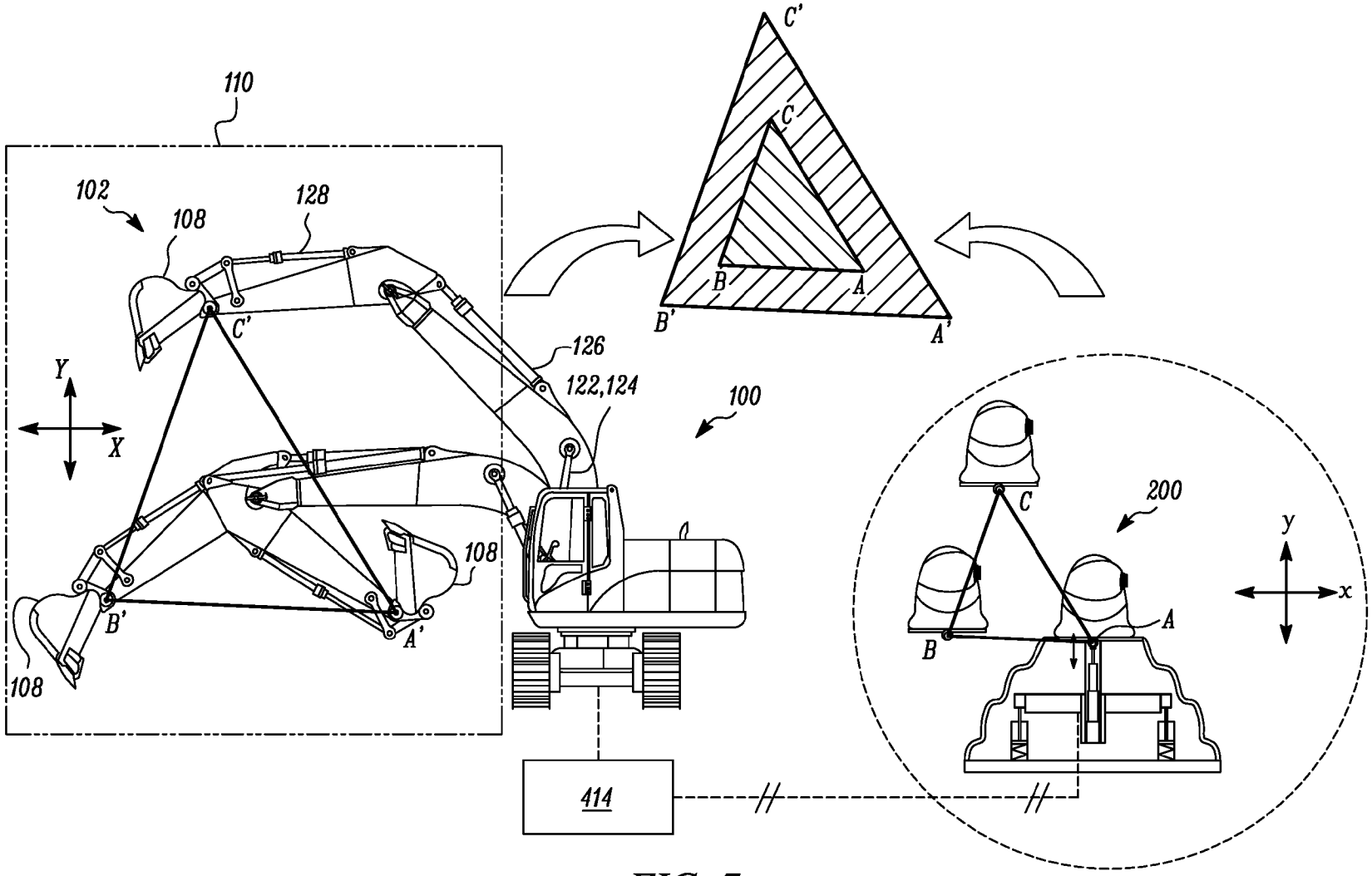
FIG. 7 illustrates a diagrammatic view of the machine and the control device showing a movement interrelationship, in accordance with an embodiment of the present disclosure.

FIGS. 5-6 illustrate range of motion diagrams for the control device 200. In the exemplary illustrations, the control device 200 is shown to be arranged at different angles with respect to the base 132. FIG. 5 illustrates the control device 200 arranged in a manner such that the central axis of the handle 230 is parallel with respect to the base 132. A first area, substantially in the form of semi-circle, and schematically indicated by numeral 500, represents possible range of motion for the handle 230 of the control device 200. Further, a second area, a subset of the first area 500 and schematically indicated by numeral 502, represents an allowable range of motion for the handle 230 of the control device 200. It may be understood that when the handle 230 is outside the second area 502, the control device 200 may be no longer able to accurately control the movement of the implement system 102. In an embodiment, if the operator tries to move the handle 230 out of the second area 502, the feedback arrangement 240 provides force feedback to constrain the handle 230 and to move the handle 230 back into the second area 502. FIG. 6, similarly, illustrates the control device 200 arranged in a manner such that the central axis of the handle 230 is at an angle (around)45° with respect to the base 132, providing a tilted control device 200. It may be contemplated that the tilting of the control device 200 is achieved by disposing the vertical members 204, 206 at the desired angle with respect to the base 132. The vertical members 204, 206, in the form of collapsible cylinders, may further allow the control device 200 to be biased at the desired angle while providing flexibility to change the angle, as required. As illustrated in FIG. 6, a first area 600 represents the possible range of motion and a second area 602 represents the allowable range of motion for the handle 230. It may be seen that the tilted control device 200 may provide a larger allowable range of motion for the handle 230, and therefore for the control device 200, and thus may be preferred for the purposes of the present disclosure.

Moreover, according to an embodiment of the present disclosure, the scaled up target position of the bucket 108 may be dependent on a pre-defined ratio, which can multiply the co-ordinates of the handle 230 with respect to the base 132 to determine the position of the bucket 108. The pre-defined ratio may be dependent on size and geometry of the implement system 102 and may be pre-programmed in the controller 414.

It may be contemplated that the controller 414 may be a logic unit, and may include a secondary storage device, a timer, and one or more processors that cooperate to accomplish a task consistent with the present disclosure. Numerous commercially available microprocessors may be configured to perform the functions of the controller 414. It should be appreciated that the controller 414 could readily embody a general machine controller capable of controlling numerous other functions of the machine 100. Various known circuits may be associated with the controller 414, including signal-conditioning circuitry, communication circuitry, and other appropriate circuitry. It should also be appreciated that the controller 414 may include one or more of an application-specific integrated circuit (ASIC), a field-programmable gate array (FPGA), a computer system, and a logic circuit configured to allow the controller 414 to function in accordance with the present disclosure.

INDUSTRIAL APPLICABILITY

The control device 200 of the present disclosure may be applicable to any excavation machine which involves planar and swinging movements of the implement system 102. The present control device 200 may help to improve machine performance and efficiency by assisting the operator to use one control device for overall movement of the implement system 102.

FIG. 5 is a diagrammatic view of the implement system 102 of the machine 100 and the control device 200 illustrating a movement interrelationship between each other. As illustrated, the handle 230 is moveable relative to the base 132 in the x-y plane by virtue of the linear movement of the linear actuator 222 and the rotational movement of the first gimbal 212. A first position (A) of the handle 230 may correspond to a first position (A') of the bucket 108 in the first vertical plane 110. The first position (A') of the bucket 108 may be a parking station position for the bucket 108 when not in use or during transportation of the machine 100. The controller 414 is configured to control and supply the hydraulic fluid pressure in the hydraulic actuators 122-128 to maintain the first position (A') of the bucket 108. As described above, the controller 414 may utilize lookup tables and position maps to map the first position (A) of the handle 230 with the first position (A') of the bucket 108, until an external force is applied on the handle 230 to change its position in the x-y plane.

While in use, in order to dig and scoop the material, the handle 230 is moved to a second position (B) in the x-y plane with respect to the base 132. In this configuration, the handle 230 is moved by coordinated linear movement of the linear actuator 222 and the rotational movement of the first gimbal 212. Thus, the bucket 108 is moved to the corresponding second position (B'). The controller 414 may initiate a coordinated and simultaneous expansion or retraction of the first and second hydraulic actuators 122-126 by supplying the hydraulic fluid. Further, the sleeve 232 and the input device 234, on the handle 230, may be turned to uncurl the bucket 108 to facilitate dig and scoop function, which may actuate the third hydraulic actuator 128. Moreover, the left and right swing of the handle 230, by virtue of the rotational movement of the second gimbal 214, may locate the bucket 108 at the desired location at a site by controlling the rotation of the fourth hydraulic actuator 130.

Further, the bucket 108 is moved to a third position (C') to empty the material into a haul truck (not shown) or at a dumping site. To achieve this, the handle 230 is raised to a corresponding third position (C) of the handle 230 by lifting up the handle 230 with respect to the base 132. Further, the bucket 108 can be uncurled to empty the material. As illustrated in FIG. 5, a first triangle ABC formed by the handle 230, using the kinematic chain, and a second triangle A'B'C' formed by the bucket 108 position in the first vertical plane 110 are similar, or in other words, the second triangle A'B'C' is scaled up version of the first triangle ABC.

Using the control device 200 of the present disclosure, the operator of the machine 100 may achieve the overall movement of the implement system 102 in the first vertical plane 110, the curl and uncurl movement of the bucket 108 relative to the stick 106, and also the swing movement of the chassis 112 and the implement system 102 about the drive system 116, all by operating and/or accessing the control operations at the handle 230 alone. Therefore, the control device 200 of the present disclosure allows for a one hand operation for controlling the movement of the implement system 102. Further, the control device 200 provides a more intuitive and simplified control over the movement of the implement system 102, which lessens the need for long training periods and on-site experience, for the operator. Moreover, based on the differential between the actual position and velocity of the bucket 108 and the position of the handle 230, the tactile force feedback is provided to the operator via the control device 200. This force feedback may guide the operator to either slowdown or even stop the movement of the handle 230, if required.

It will be apparent to those skilled in the art that various modifications and variations can be made to the disclosed control device and hydraulic control system. Other embodiments will be apparent to those skilled in the art from consideration of the specification and practice of the disclosed control device and hydraulic control system. It is intended that the specification and examples be considered as exemplary only, with a true scope being indicated by the following claims and their equivalents.

I claim:

1. A control device for an implement system of a machine, the control device mounted on a support and comprising:

a first gimbal rotatably coupled to the support;

a second gimbal rotatably coupled to the first gimbal;

a linear actuator having a first end and a second end, the linear actuator fixed to the second gimbal from the first end; and a handle attached to the linear actuator at the second end, the handle configured to move in conjunction with rotational movements of the first gimbal and the second gimbal, and a linear movement of the linear actuator to control a movement of the implement system.

2. The control device of claim 1 further comprising, a rotatable sleeve disposed on the handle, the rotatable sleeve configured to control the movement of the implement system.

3. The control device of claim 2 further comprising, an input device disposed on the handle, the input device configured to change a sensitivity of the rotatable sleeve for controlling the movement of the implement system.

4. The control device of claim 1, wherein the linear movement of the linear actuator is controlled by varying a distance between the first end and the second end.

5. The control device of claim 1, wherein the linear actuator is configured to provide a force feedback at the handle, by constraining the linear movement of the linear actuator, based on the movement of the implement system.

6. The control device of claim 1 further comprising:

a first rotational actuator connected to the first gimbal and configured to provide a force feedback at the handle, by constraining the rotational movement of the first gimbal about the support, based on the movement of the implement system; and a second rotational actuator connected to the second gimbal and configured to provide a force feedback at the handle, by constraining the rotational movement of the second gimbal about the first gimbal, based on the movement of the implement system.

7. The control device of claim 6, wherein the first gimbal is coupled to the support by two rotational joints.

8. The control device of claim 7, wherein the first rotational actuator is connected to the first gimbal at one of the two rotational joints.

9. The control device of claim 6, wherein the second gimbal is coupled to the first gimbal by two rotational joints.

10. The control device of claim 9, wherein the second rotational actuator is connected to the second gimbal at one of the two rotational joints.

11. The control device of claim 1, wherein the linear actuator is a telescopic piston cylinder device.

12. A machine comprising:

an implement system;

a hydraulic control system configured to operate the implement system;

a control device for the implement system, the control device mounted on a support and comprising:

a first gimbal rotatably coupled to the support;

a second gimbal rotatably coupled to the first gimbal;

a linear actuator having a first end and a second end, the linear actuator fixed to the second gimbal from the first end;

a handle attached to the linear actuator at the second end, the handle configured to move in conjunction with rotational movements of the first gimbal and the second gimbal, and a linear movement of the linear actuator to control a movement of the implement system;

a rotatable sleeve disposed on the handle, the rotatable sleeve configured to control the movement of the implement system;

a first rotational actuator connected to the first gimbal and configured to constrain the rotational movement of the first gimbal about the support; and a second rotational actuator connected to the second gimbal and configured to constrain the rotational movement of the second gimbal about the first gimbal; and a controller configured to control the hydraulic control system and thereby operate the implement system in response to at least one of a movement of the handle and a turning of the rotatable sleeve.

13. The machine of claim 12, wherein:

the linear actuator is configured to provide a force feedback at the handle, by varying a distance between the first end and the second end, based on the movement of the implement system;

the first rotational actuator is configured to provide a force feedback at the handle, by constraining the rotational movement of the first gimbal about the support, based on the movement of the implement system; and the second rotational actuator is configured to provide a force feedback at the handle, by constraining the rotational movement of the second gimbal about the first gimbal, based on the movement of the implement system.

14. The machine of claim 13, wherein the controller is further configured to determine a differential between a target position of the implement system and an actual position of the implement system, and provide a force feedback at the handle, for an operator of the machine, via at least one of the linear actuator, the first rotational actuator and the second rotational actuator based on the determined differential.

15. The machine of claim 12, wherein the implement system comprises a boom, a stick and a bucket.

16. The machine of claim 15, wherein the hydraulic control system comprises:

a first hydraulic actuator associated with the boom and configured to control a movement thereof;

a second hydraulic actuator associated with the stick and configured to control a movement thereof; and a third hydraulic actuator associated with the bucket and configured to control a movement thereof.

17. The machine of claim 16, wherein the controller is configured to control a supply of hydraulic fluid to the first, second, and third hydraulic actuators in response to at least one of the movement of the handle and the turning of the rotatable sleeve.

18. An excavator comprising:

a drive system;

a chassis rotatably supported on the drive system;

an operator station supported on the chassis;

an implement system, comprising:

a boom pivotally connected to the chassis;

a stick pivotally connected to the boom; and a bucket pivotally connected to the stick;

a hydraulic control system configured to operate the implement system, the hydraulic control system comprising:

a first hydraulic actuator associated with the boom, the first hydraulic actuator configured to rotate the boom with respect to the chassis;

a second hydraulic actuator associated with the stick, the second hydraulic actuator configured to rotate the stick with respect to the boom;

a third hydraulic actuator associated with the bucket, the third hydraulic actuator configured to rotate the bucket with respect to the stick; and a fourth hydraulic actuator associated with the chassis, the fourth hydraulic actuator configured to rotate the chassis with respect to the drive system;

a control device for the implement system, the control device mounted on a support provided in the operator station, the control device comprising:

a first gimbal rotatably coupled to the support;

a second gimbal rotatably coupled to the first gimbal;

a linear actuator having a first end and a second end, the linear actuator fixed to the second gimbal from the first end;

a handle attached to the linear actuator at the second end, the handle configured to move in conjunction with rotational movements of the first gimbal and the second gimbal, and a linear movement of the linear actuator, to control a movement of the implement system;

a rotatable sleeve disposed on the handle, the rotatable sleeve configured to control the movement of the implement system;

a first rotational actuator connected to the first gimbal and configured to constrain the rotational movement of the first gimbal about the support; and a second rotational actuator connected to the second gimbal and configured to constrain the rotational movement of the second gimbal about the first gimbal; and a controller configured to control a supply of hydraulic fluid to the first, second, third and fourth hydraulic actuators in the hydraulic control system and thereby operate the implement system in response to at least one of a movement of the handle and a turning of the rotatable sleeve.

19. The excavator of claim 18, wherein:

the linear actuator is configured to provide a force feedback at the handle, by varying a distance between the first end and the second end, based on the movement of the implement system;

the first rotational actuator is configured to provide a force feedback at the handle, by constraining the rotational movement of the first gimbal about the support, based on the movement of the implement system; and the second rotational actuator is configured to provide a force feedback at the handle, by constraining the rotational movement of the second gimbal about the first gimbal, based on the movement of the implement system.

20. The excavator of claim 19, wherein the controller is further configured to determine a differential between a target position of the implement system and an actual position of the implement system, and provide a forced feedback at the handle, for an operator of the excavator, via at least one of the linear actuator, the first rotational actuator and the second rotational actuator based on the determined differential.

* * * * *